US008820034B1

(12) United States Patent
Watts et al.

(10) Patent No.: US 8,820,034 B1
(45) Date of Patent: Sep. 2, 2014

(54) LOW THERMAL BRIDGE BUILDING COMPONENTS

(71) Applicant: Thermal Framing, LLC., Island Park, ID (US)

(72) Inventors: Kenneth D. Watts, Island Park, ID (US); Donald G. M. Watts, Golden, CO (US)

(73) Assignee: Thermal Framing, LLC., Island Park, ID (US)

( * ) Notice: Subject to any disclaimer, the term of this patent is extended or adjusted under 35 U.S.C. 154(b) by 0 days.

(21) Appl. No.: 14/104,734

(22) Filed: Dec. 12, 2013

Related U.S. Application Data

(63) Continuation-in-part of application No. 13/778,113, filed on Feb. 26, 2013, now Pat. No. 8,640,429.

(60) Provisional application No. 61/603,945, filed on Feb. 28, 2012.

(51) Int. Cl.
*E04C 3/00* (2006.01)

(52) U.S. Cl.
USPC ..... 52/838; 52/404.1; 52/481.1; 52/404.3

(58) Field of Classification Search
CPC ..... E04C 3/14; E04C 3/16; E04C 3/29; E04C 2003/0421; E04C 2003/0434; E04C 2003/0452
USPC ..... 52/838, 404.1, 404.3, 481.1
See application file for complete search history.

(56) References Cited

U.S. PATENT DOCUMENTS

| | | | | | |
|---|---|---|---|---|---|
| 4,336,678 | A * | 6/1982 | Peters | 52/837 |
| 4,578,909 | A * | 4/1986 | Henley et al. | 52/91.3 |
| 5,617,693 | A * | 4/1997 | Hefner | 52/693 |
| 5,625,996 | A * | 5/1997 | Bechtel | 52/843 |
| 5,678,381 | A * | 10/1997 | DenAdel | 52/836 |
| 5,966,894 | A * | 10/1999 | Crump, Jr. | 52/841 |
| 6,276,110 | B1 * | 8/2001 | Karlsson | 52/836 |
| 6,412,249 | B1 * | 7/2002 | Boyer et al. | 52/481.1 |
| 6,460,310 | B1 * | 10/2002 | Ford et al. | 52/837 |
| 6,701,690 | B2 * | 3/2004 | Deschenes | 52/837 |
| 6,772,572 | B2 * | 8/2004 | Henthorn | 52/847 |
| 7,905,073 | B2 * | 3/2011 | Brandes et al. | 52/838 |
| 2008/0134619 | A1 * | 6/2008 | Nichols et al. | 52/690 |
| 2010/0293889 | A1 * | 11/2010 | DeBoef, Jr. | 52/837 |

* cited by examiner

*Primary Examiner* — Mark Wendell
(74) *Attorney, Agent, or Firm* — Jeffrey Parry Intellectual Property Law Group PLLC; Jeffrey C. Parry

(57) ABSTRACT

Building components having a reduced thermal bridge relative to traditional building components. In embodiments, a beam comprises at least two flanges and a web connecting the flanges and maintaining the flanges in a roughly parallel configuration to each other. In embodiments, the web comprises multiple web pieces having reduced cross sections. In alternative embodiments, the web comprises a single continuous web piece with a reduced cross section. In alternative embodiments, the web comprises one or more foam or honeycomb pieces.

16 Claims, 9 Drawing Sheets

LOW THERMAL BRIDGE BUILDING COMPONENTS

CROSS-REFERENCE TO RELATED APPLICATIONS

This application is a continuation-in-part of U.S. patent application Ser. No. 13/778,113, filed Feb. 26, 2013, and titled "LOW THERMAL BRIDGE BUILDING COMPONENTS," which claims priority to U.S. Provisional Patent Application Ser. No. 61/603,945, filed on Feb. 28, 2012, and titled "LOW THERMAL BRIDGE STUDS, PLATES, AND HEADERS." This application claims priority to all such previous applications, and the entire contents of such applications are hereby incorporated herein by reference.

BACKGROUND

1. Technical Field

The present disclosure relates generally to reduced thermal bridging across structures and building components. More particularly, the disclosure relates to reduced thermal bridge studs, plates, and other building components.

2. Background

Building codes in the United States, Europe, and elsewhere are becoming more and more restrictive with regard to energy use than in times past. It is anticipated that as time passes, many of the building codes will require more insulation, less air leakage, higher performance windows and doors, and other like components in order to reduce energy usage.

When used for framing, commonly-used 2×4s, 2×6s, 2×8s, 2×10s, 2×12s, etc. are typically made of solid wood. Such solid wood studs and plates may transfer significant heat energy through framed walls. Builders typically attempt to avoid thermal bridging by building double walls on the outer perimeter of buildings or by using other complicated framing configurations. This approach may be effective but can double the labor and material for framing. Builders typically may use complex methods to join the double walls at the top plate to roof interface to achieve structural integrity. This double wall approach can also be costly and time consuming.

In some cases, builders may also use single or multiple layers of rigid foam insulation on the outside of a building's sheathing to reduce thermal bridging. This approach can also be very labor intensive and the materials can be costly. Following the application of the rigid insulation, builders typically then install vertical battens that are used to attach the building siding. These vertical battens are attached to the building wall using long screws. This building approach is also typically costly and labor-intensive.

What is needed, therefore, is a building method that is less labor-intensive and less costly than the foregoing approaches, while resulting in a relatively low thermal bridge.

SUMMARY

In one embodiment, a low thermal bridge building component is disclosed. The low thermal bridge building component includes at least two flanges and a web joining the at least two flanges and maintaining the outer surfaces of the at least two flanges in a roughly parallel configuration. The web has an R-value between 12 and 54 and comprises a perforation.

In another embodiment, a low thermal bridge wall component is disclosed. The low thermal bridge wall component includes at least two flanges and a web joining the at least two flanges and maintaining the at least two flanges in a roughly parallel configuration. The web has a single, integral web member. The web member is the only member that joins the at least two flanges.

The present disclosure will now be described more fully with reference to the accompanying drawings, which are intended to be read in conjunction with both this summary, the detailed description, and any preferred or particular embodiments specifically discussed or otherwise disclosed. This disclosure may, however, be embodied in many different forms and should not be construed as limited to the embodiments set forth herein; rather, these embodiments are provided by way of illustration only so that this disclosure will be thorough, and fully convey the full scope of the disclosure to those skilled in the art.

DETAILED DESCRIPTION

In the following description, reference is made to the accompanying drawings that form a part thereof, and in which is shown by way of illustration specific exemplary embodiments in which the embodiments of the disclosure may be practiced. These embodiments are described in sufficient detail to enable those skilled in the art to practice the disclosure, and it is to be understood that modifications to the various disclosed embodiments may be made, and other embodiments may be utilized, without departing from the spirit and scope of the disclosure. The following detailed description is, therefore, not to be taken in a limiting sense.

One method of reducing energy usage in a building is to reduce conductive heat loss from thermal bridging through the exterior wall structure of the building. Thermal bridging may be reduced through the use of construction materials having relatively high thermal resistance, by reducing the cross-sectional area of wall structures, or through a combination of both. In the context of this disclosure, a cross-sectional area is defined as the intersection of the building component or element in question with a plane that is parallel to a wall or similar construction into which the building component or element may be integrated. As such, within the context of this disclosure, a cross-sectional area may typically be roughly perpendicular to a direction of heat transfer conduction through the construction component. One objective of the low thermal bridge building components is to reduce thermal bridging and resulting energy loss through these components in buildings. The low thermal bridge components disclosed herein may significantly reduce conductive heat transfer and thus reduce the energy required to heat or cool a residential, commercial, or other type of building.

Low thermal bridge studs, plates, and other building components disclosed herein may allow builders to use standard construction techniques. Construction time and procedures may be similar to conventional wall framing using standard construction techniques with dimensional lumber. Construction costs may also be similar to standard construction costs using dimensional lumber. Walls constructed using building components and methods disclosed herein can be thick and thus allow for thick insulation having high R-values, while still being light weight and using less wood for framing compared to conventional techniques.

Figure 1:
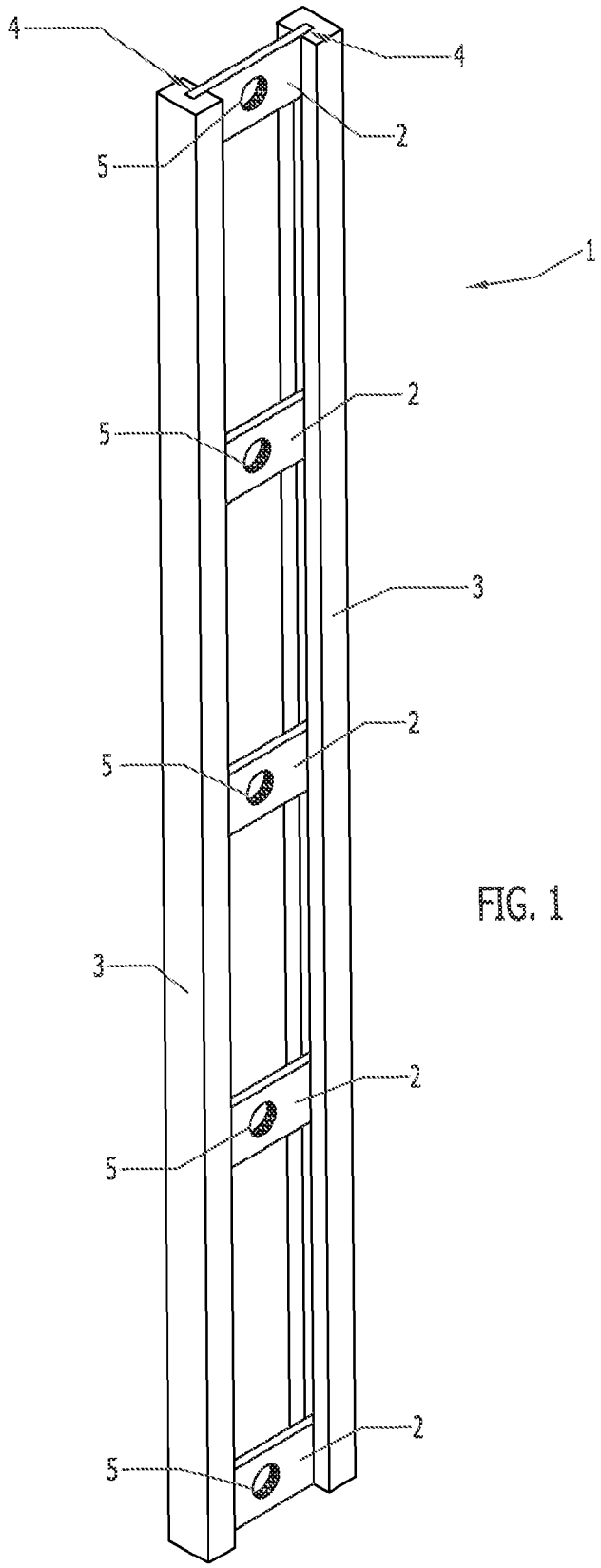
FIG. 1 depicts a reduced thermal bridge structure component arranged in a configuration similar to an I-beam according to an embodiment of the present disclosure.

As shown in FIG. 1, the low thermal bridge building component 1 according to embodiments of the present disclosure is arranged similar to an I-beam, having roughly parallel opposing flanges 3 and a web 2 that connect the flanges 3. In embodiments, web 2 comprises a thin cross-section relative to flanges 3 to reduce conductive heat transfer from one flange 3 to the other. In embodiments, web 2 is perforated with holes 5 and/or comprises non-continuous web pieces, as shown in FIG. 1, to further reduce the cross-sectional area and resultant conductive heat transfer.

A standard 8 foot long dimensional lumber stud has a cross-sectional area of approximately 144 square inches (1.5 inches×96 inches). The low thermal bridge building component 1 has a much smaller cross-sectional area than a traditional standard dimensional lumber stud. In the embodiment depicted in FIG. 1, there are five webs 2 that are approximately 4 inches tall and ½ inch wide. As a result, the lateral cross-sectional area across the web 2 is 10 square inches (4 inches×½ inch×5 webs). This area is roughly 6.94% of the cross-sectional area of a standard dimensional lumber stud having the same height. In addition, if a 2-inch diameter hole 5 is added to each piece of the web 2, the cross-sectional area of the web 2 is reduced to 5 square inches while still maintaining the same web-to-flange glue joint 4 length. This area is roughly 3.47% of the cross-sectional area of a standard stud. This reduced cross-sectional area may greatly reduce thermal bridging and the resultant heat loss or gain. Embodiments that are made with less wood may, as a result, comprise less material volume than conventional building components. As used herein, "material volume" refers to the volume of material of a building component without counting any internal voids. For example, traditional dimensional lumber that is 1.5 inches wide, 96 inches tall, and 10 inches thick may comprise a material volume of approximately 1440 cubic inches (96 inches×1.5 inches×10 inches). As an additional example, the embodiment depicted in FIG. 1 having flanges that are 1.5 inches wide, 1 inch thick and 96 inches tall and webs that are 4 inches tall, ½ inches thick, and 8 inches wide may comprise a material volume of approximately 368 cubic inches (96 inches×1.5 inches×1 inch×2 flanges+4 inches×½ inch×8 inches×5 webs). As an additional example, the embodiment depicted in FIG. 1 having flanges that are 3.5 inches wide, 1 inch thick and 96 inches tall and webs that are 4 inches tall, ½ inches thick, and 9.25 inches wide may comprise a material volume of approximately 764.5 cubic inches (96 inches×3.5 inches×1 inch×2 flanges+4 inches×½ inch×9.25 inches×5 webs). A target material volume amount may be selectively achieved by varying one or more of the component dimensions.

Embodiments of the present disclosure having less material volume than similarly-sized traditional dimensional lumber may, as a result, weigh less than similarly-sized traditional dimensional lumber. Table 1 illustrates typical weights for various dimensional lumber beams.

TABLE 1

Dimensions for conventional dimensional lumber.

| Nominal | Overall Width | Overall Thickness | Weight per 8 feet of length |
|---|---|---|---|
| 2x6 | 1.5 inches | 5.5 inches | 14.73 pounds |
| 2x8 | 1.5 inches | 7.25 inches | 19.42 pounds |
| 2x10 | 1.5 inches | 9.25 inches | 24.78 pounds |
| 2x12 | 1.5 inches | 11.25 inches | 30.13 pounds |

In comparison, similarly-sized embodiments of the present disclosure may weigh substantially less than typical dimensional lumber beams. Table 2 depicts measured weights for building components according to the present disclosure.

TABLE 2

Dimensions for embodiments of the present disclosure.

| Nominal | Overall Width | Overall Thickness | Weight per 8 feet of length |
|---|---|---|---|
| 2x6 | 1.5 inches | 5.5 inches | 13.06 pounds |
| 2x8 | 1.5 inches | 7.25 inches | 13.46 pounds |
| 2x10 | 1.5 inches | 9.25 inches | 13.92 pounds |
| 2x12 | 1.5 inches | 11.25 inches | 14.38 pounds |

The conductive heat transfer through a wall stud is directly proportional to the cross-sectional area of the stud. If the cross-sectional area is reduced, the heat transfer may be reduced proportionally. Therefore, the embodiment depicted in FIG. 1 may reduce conductive heat transfer to approximately 6.94% without a hole 5 in the web 2 or approximately 3.47% with a hole 5 in the web 2 compared to conductive heat transfer through a standard dimensional lumber stud. Embodiments of the building component 1 comprise a longitudinal length of 8 feet (the longitudinal direction being defined in the direction of greatest size of the building component). In alternative embodiments, the length of building component 1 may be selectively designed according to specific circumstances and building criteria. Because there is essentially no air movement in the wall cavities between studs, thermal conduction through wall studs and other components may be assumed to be the primary driver of heat transfer through wall assemblies. (In a typical installation, there is little to no air movement in the cavities in part because of the insulation that is installed within the wall.)

In a typical installation, building component 1 may be installed within a wall with each flange 3 abutted and affixed to a wall surface. For example, one flange 3 may be affixed to drywall panels forming an interior wall. That flange 3 would accordingly comprise an inner-facing flange 3 and the flange 3 surface which abuts the drywall panels may comprise a peripheral inner-facing surface. Likewise, the other flange 3 may be affixed to exterior wall panels at the peripheral outer-facing surface of that flange 3. However, it is to be understood that the peripheral inner-facing surface and the peripheral outer-facing surface of building component 1 might not necessarily be affixed to an interior or exterior wall, respectively.

Figure 2:
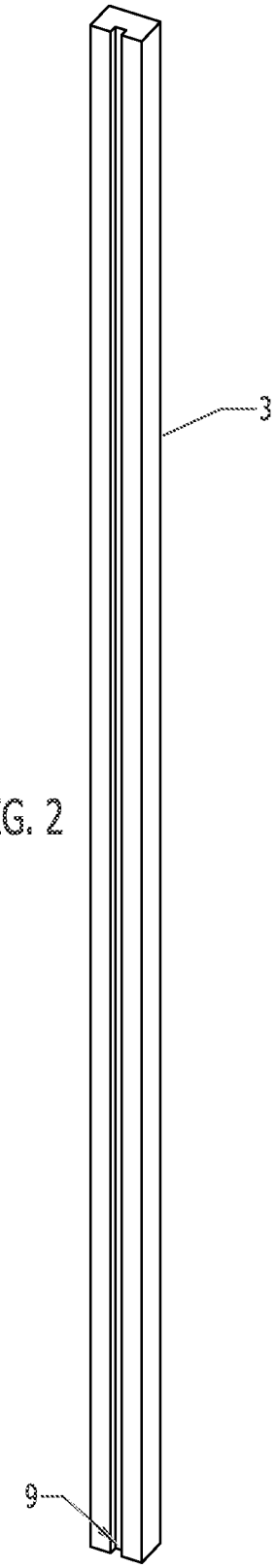
FIG. 2 depicts a flange member according to embodiments of the present disclosure.
Figure 3:
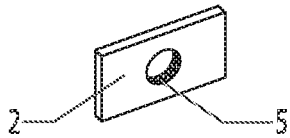
FIG. 3 depicts a web piece according to embodiments of the present disclosure.

FIG. 2 illustrates an embodiment of a flange member 3. Embodiments of the studs, plates, and like building components of the present disclosure may be constructed by cutting a groove 9 in the flange members 3 to accommodate the placement of the web pieces 2. FIG. 3 illustrates an embodiment of a web piece 2. Web pieces 2 may be glued and/or fastened in place in the groove 9 using means known in the art to maintain the integrity and strength of the assembly and create the I-beam-like configuration. The webs 2 and flanges 3 are sized to attain the desired dimensions and strength of the assembled building component 1. The length of the web 2 can be selectively sized to accommodate the desired wall thickness and also the desired wall insulation thickness. The length of the flanges 3 can also be varied to accommodate various wall heights and/or lengths.

In embodiments of the present disclosure, the webs 2 and flanges 5 may be constructed using dimensional lumber or engineered materials such as oriented strand board (OSB), plywood, laminated veneer lumber (LVL), laminated strand lumber (LSL), rim-board, glued laminated lumber (glulam), like materials, or combinations thereof. Use of engineered materials may provide increased dimensional stability in comparison to dimensional lumber. Dimensional stability may also be improved in components where dimensional lumber is used because the movement of one flange 3 can be counteracted by the other due to the webs 2 that connect the flanges 3. Alternatively, the flanges 3, webs 2, or both may be manufactured from other materials such as aluminum, steel, or plastic or plastic composites. The web may also be made of honeycomb, rigid foam insulation, or other insulating material to reduce the thermal bridge between the flanges 3. As will be understood by one of ordinary skill in the art having the benefit of this disclosure, other materials of manufacture may be suitable for the web 2 and flanges 3. Such materials fall under the scope of this disclosure.

Dimensional lumber used for framing buildings may be prone to cupping, bowing, twisting, and crowning. This dimensional instability may cause the dimensional lumber to be more difficult to frame for doors and windows because it may be difficult to keep the door and window rough openings square, level, plumb, and flat for window mounting and door hanging. Embodiments of low thermal bridge building components according to the present disclosure may be more dimensionally stable, which could allow for easier and better installation of doors and windows. This advantage may be especially pronounced where engineered wood products are used for the flanges 3 of the building components. The use of flanges 3 that are wider than dimensional lumber may also provide a wider nailing surface, which may result in fewer nail misses during construction.

Webs 2 may be cut from dimensional lumber or from the types of engineered wood products mentioned above. For embodiments that comprise holes 5 in the webs 2, such holes can be drilled, punched, or made using other methods. These holes 5 may further reduce the heat transfer through the web 2 by reducing the cross-sectional area of each web 2 without significant reduction of the strength of the web 2 or the web-to-flange joint. Web 2 thickness and width can be selected to meet the structural requirements of the assembly and the insulation requirements of the building's walls. The flanges 3 can be made from dimensional lumber or engineered wood products. The groove 9 can be cut using a dado blade on a table saw or other suitable milling technique. The cross-sectional dimensions of the flanges 3 are selected to meet structural and rigidity requirements of the assembly. For example, buildings that are constructed in areas with high snow loads may need larger flanges 3 to meet structural buckling requirements. The strength and/or rigidity of the flanges 3 may be based on their area moment of inertia. For a rectangular lateral cross-section of a flange member 3, the mathematical formula for the area moment of inertia is:

$$I = \frac{b \times d^3}{12}$$

where:

I is the moment of inertia of the flange member 3;

b is the side-to-side thickness of the flange member 3; and d is the depth of the flange member 3 in the direction that a force is applied.

This equation shows that a small increase in the depth can greatly increase the strength and rigidity of the flange 3 when it is subjected to bending or column loading because the depth is cubed in the equation. The flange 3 dimensions may also be selected to allow for fastening of sheet material (e.g. OSB or the like) and/or siding to the outside flange 3 and materials such as sheetrock or wood products to the inside flange 3. Use of wide flanges 3 may reduce the chance for nails or screws to miss the studs during attachment of sheeting products.

Building component embodiments according to the present disclosure may be constructed by applying glue to grooves 9 and then forcing the webs 2 and flanges 3 together using clamps or other suitable means, thereby forming joints 4 between web 2 and flanges 3. The width of groove 9 may be selected to allow for a forced fit with the webs 2 so that the assembly retains its integrity after the clamping force is removed. Assembly fixtures may be used during assembly to maintain the dimensional integrity of the low thermal bridge building component 1 (in other words, maintaining the component flat, straight, etc.). In alternative embodiments, the webs 2 are nailed and/or stapled to the flanges 3. In addition or alternatively, the webs 2 are placed in mortised holes that are a partial or full depth of the flanges 3.

Figure 4:
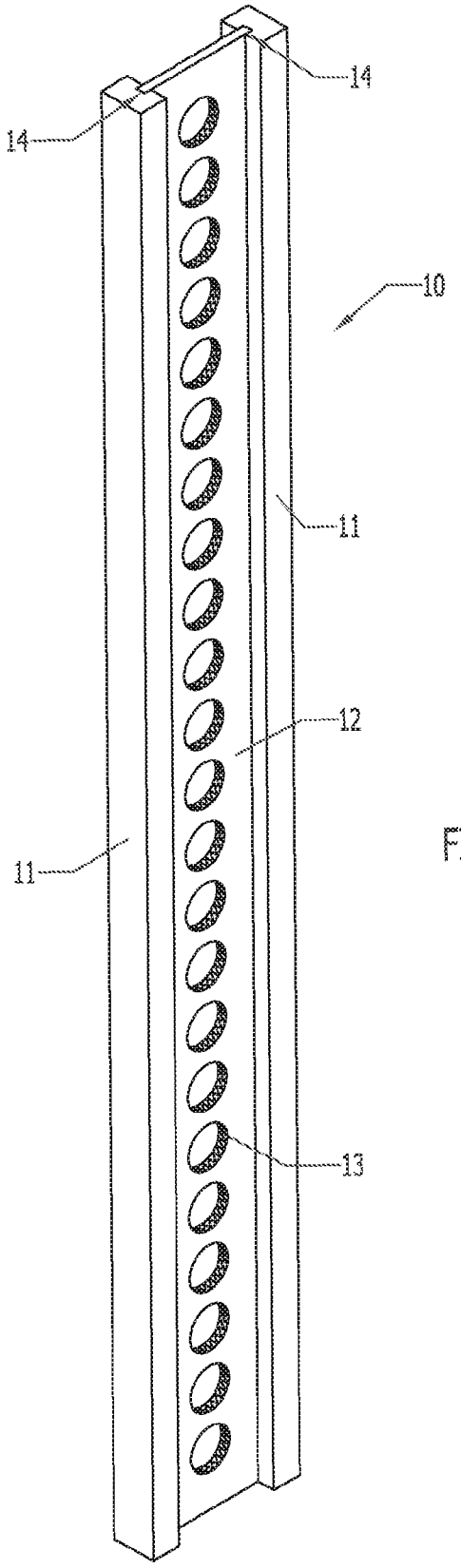
FIG. 4 depicts a reduced thermal bridge structure having a continuous web according to an embodiment of the present disclosure.

FIG. 4 depicts an embodiment of a low thermal bridge building component 10 according to the present disclosure. As illustrated in FIG. 4, embodiments achieve relatively low thermal bridging by incorporating numerous holes 13 in a continuous web 12. This approach may allow for field cutting the assembly 10 to attain the desired length without regard for the placement of multiple web pieces. However, the web-to-flange joints 14 of this embodiment may be significantly stronger because the joints 14 are continuous along the flanges 11 and web 12. The fabrication approach may be similar to that used for the embodiment depicted in FIG. 1.

As an example, if 2 inch diameter holes 13 are spaced to leave ½ inch of web 12 material between the holes, the resulting cross-sectional area of the assembly is approximately 10 square inches for an 8 foot long stud. Accordingly, such a building component has a cross-sectional area that is approximately 6.94% of a standard dimensional lumber stud and thus will have only approximately 6.94% of the conductive heat transfer of a dimensional lumber stud. Various hole 13 sizes and/or spacing may achieve different results.

Figure 5:
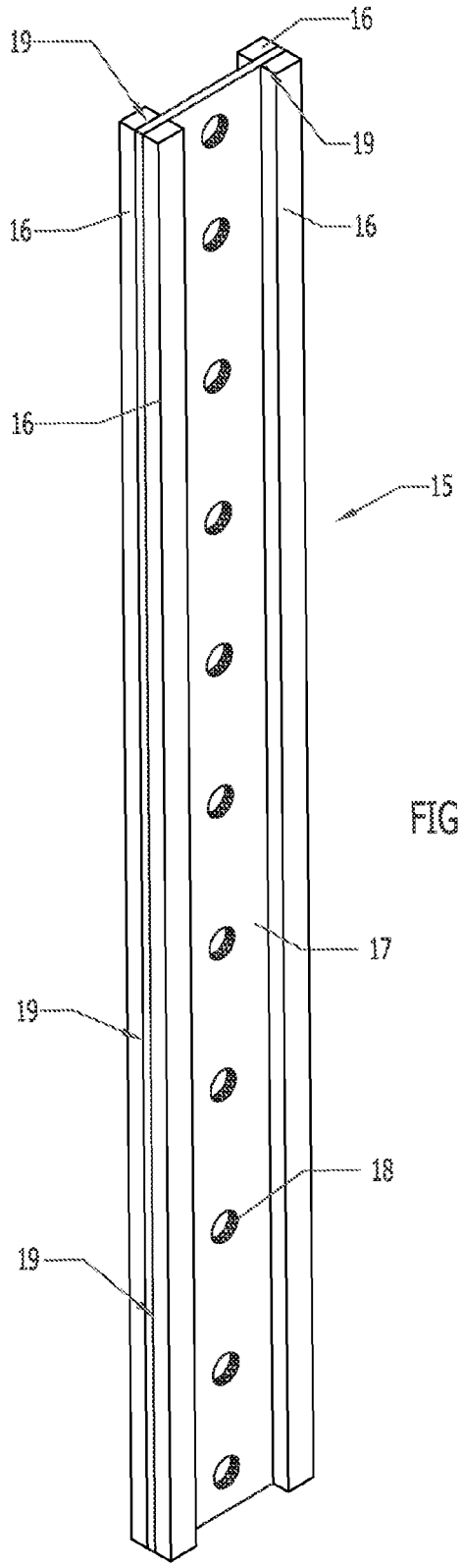
FIG. 5 depicts a reduced thermal bridge structure having a laminated construction according to an embodiment of the present disclosure.

Referring to FIG. 5, an embodiment of a building component 15 according to the present disclosure comprises OSB, dimensional lumber, or other material that is laminated together to form a low thermal bridge configuration. The web 17 has multiple holes 18 to further reduce thermal bridging. The building component 15 can be fabricated using standard sawing and milling techniques. The components can be glued together or otherwise fastened to attain the desired structural integrity. Web 17 length can be selected to achieve the desired building wall thickness. The thickness of the four flange pieces 16 can be selected to achieve the desired stiffness and strength. The overall flange 16 thickness may generally be thicker than the thickness of standard lumber studs and plates because of the I-beam-like configuration. The glue joints 19 may provide relatively high shear strength to the building component 15, which may allow it to accommodate high lateral wind loads in a building wall assembly.

Figure 6:
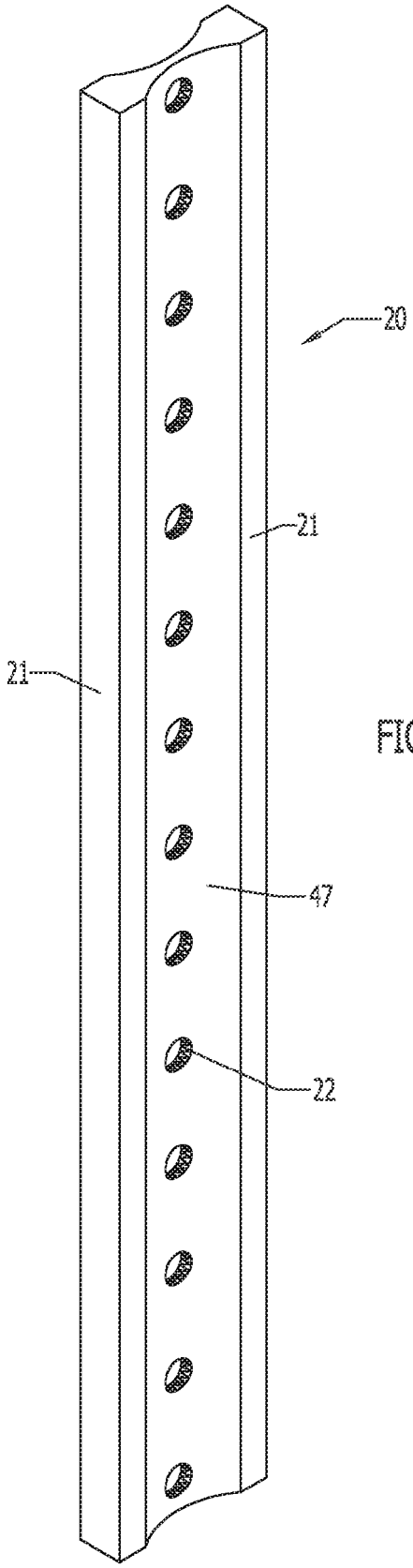
FIG. 6 depicts a reduced thermal bridge structure having a curved web piece according to an embodiment of the present disclosure.

FIG. 6 depicts an embodiment of a building component 20 according to the present disclosure. Embodiments of building component 20 comprise a solid OSB, LSL, rim board, or similar material pressing. This configuration has a relatively thin web 47 at its middle and multiple holes 22 to reduce thermal bridging. Embodiments of building component 20 have a web 47 comprising a curved surface with a curve radius of approximately four inches. Embodiments of building component 20 have a web 47 comprising a thickness at its middle that is less than one-fourth of its thickness at its edges. Alternatively, web 47 dimensions may be selectively varied to meet specific circumstances such as cost, weight, strength, and/or thermal bridging requirements. Alternative embodiments are constructed using plywood, LVL, LSL, or glulam materials. One possible benefit of embodiments of building component 20 is that a "net final" shape may be achieved and there may be no need for further fabrication. Building component 20 may be constructed using techniques similar to those currently used to make LSL studs and/or rim boards. Shaped rollers may be used to form the I-beam-like configuration and curved web 47. Building component 20 may be manufactured by unevenly building up wood chips prior to pressing to create the varying thickness of web 47.

Figure 7:
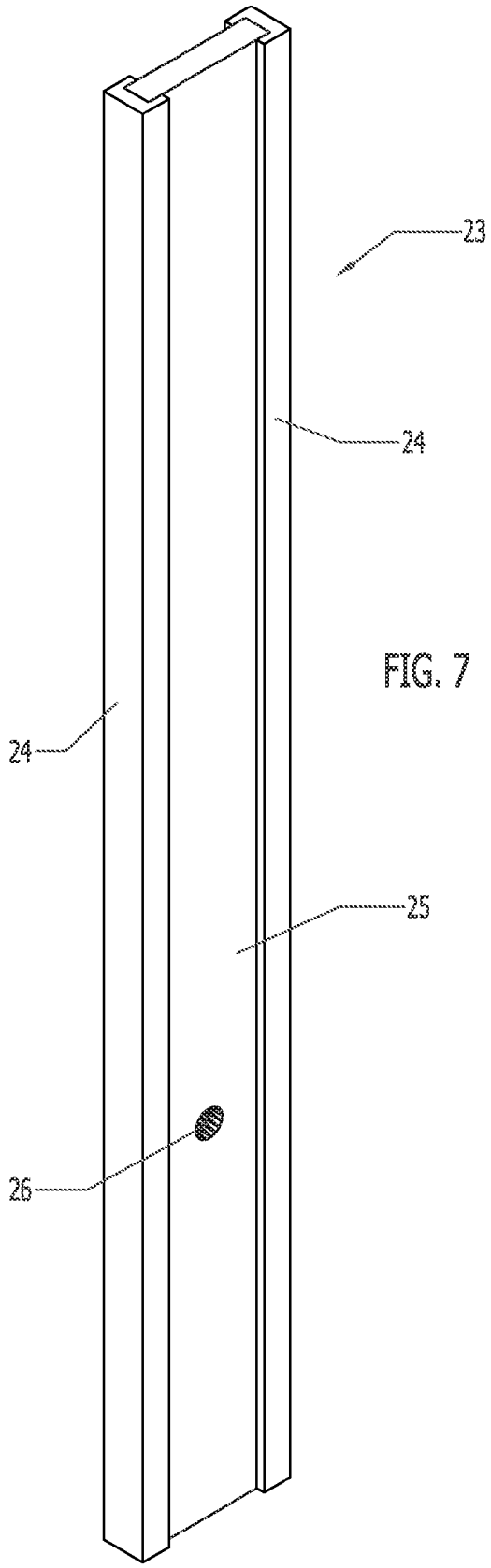
FIG. 7 depicts a reduced thermal bridge structure having flanges bracketing a web according to an embodiment of the present disclosure.

FIG. 7 depicts an embodiment of a building component 23 comprising flanges 24 made of dimensional lumber, OSB, plywood, LVL, LSL, rim board, or other like material and web 25 that is made of honeycomb or rigid foam insulation (for example, polystyrene, polyisocyanurate, and/or polyurethane). The web 25 provides the low thermal bridge due to its relatively high R-value compared to the flanges 24. Building component 23 may comprise an I-beam shaped configuration due to the flanges 24 being slightly thicker than web 25. As depicted in FIG. 7, web 25 is bracketed by C-shaped flanges 24. In embodiments, web 25 is roughly the same thickness as the flanges 24. In embodiments, web 25 comprises a single, integral piece of honeycomb or rigid foam insulation material. Such an embodiment of web 25 comprises no separate side pieces or end pieces. Some embodiments include no other material besides the material of web 25 bridging the flanges 24. The web 25 may be glued to the flanges 24. Embodiments comprise hole 26 passing through web 25 to accommodate routing of electrical or instrumentation wiring or to allow for routing of plumbing. The width of web 25 may be selected to attain the wall thickness and R-value desired. In embodiments, the relatively wide building component 23 may exhibit higher thermal resistance than wall cavities insulated with cellulose or fiberglass. The thickness and width of the flanges 24 may be selected to achieve the desired stiffness and strength. The web 25 and flange 24 can be fabricated using standard construction techniques and tools. Embodiments of building component 23 may result in joints with high shear strength because of the relatively large glue area. Embodiments of the present disclosure may also provide for substantial sound attenuation.

Embodiments comprising a web 25 that is made of honeycomb or rigid foam may exhibit superior thermal insulating properties relative to traditional building components. For example, one embodiment comprises two wood flanges, each flange having a thickness of approximately 1.5 inches, and a rigid polystyrene web having a thickness of 2.5 inches. A polystyrene web that is 2.5 inches thick may have an R-value of approximately 12.5, using a commonly-accepted R-value of polystyrene of 5/inch. The flanges may have a cumulative R-value of approximately 3.75, using a commonly-accepted R-value of wood of 1.25/inch. Thus, such a building component embodiment may have a total R-value of approximately 16.25. As another example, an embodiment comprises two wood flanges, each flange having a thickness of approximately 1.5 inches, and a rigid polyisocyanurate web having a thickness of 8.25 inches. A polyisocyanurate web that is 8.25 inches thick may have an R-value of approximately 53.63, using a commonly-accepted R-value of polyisocyanurate of 6.5/inch. The flanges may have a cumulative R-value of approximately 3.75. Thus, such a building component embodiment may have a total R-value of approximately 57.38. By varying the thickness of the web and/or flanges or by varying the materials of the web and/or flanges, components having other R-values are conceivable.

An alternate fabrication approach is to spray foam insulation between two flanges 24 that are held flat and parallel by fixtures. This approach may be accomplished without glue or fasteners, as the spray foam may adhere directly to the flanges 24. The continuous web 25 may allow the building component 23 to be cut to any length without compromising the structural integrity of the assembly. Long component 23 lengths may be achieved using embodiments of building component 23.

Figure 8A:
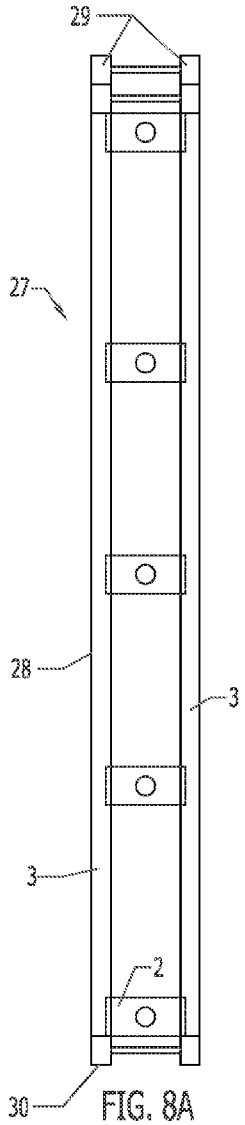
FIGS. 8A, 8B, and 8C depict a wall assembly having a reduced thermal bridge according to embodiments of the present disclosure.
Figure 8B:
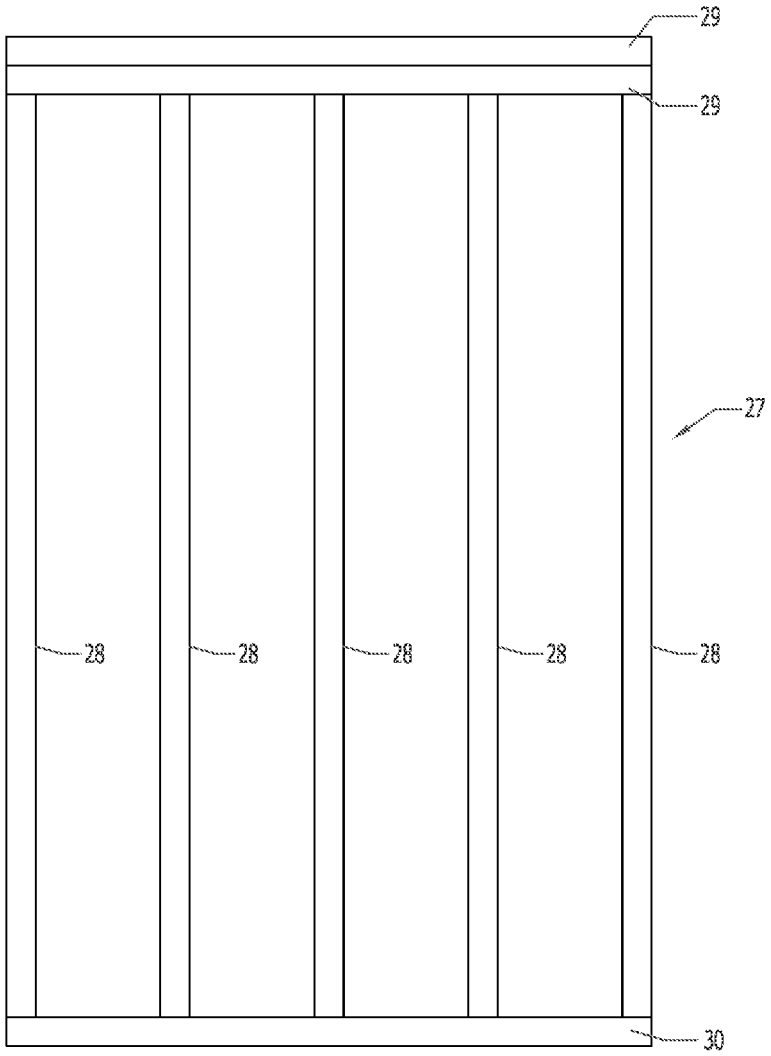
Figure 8C:
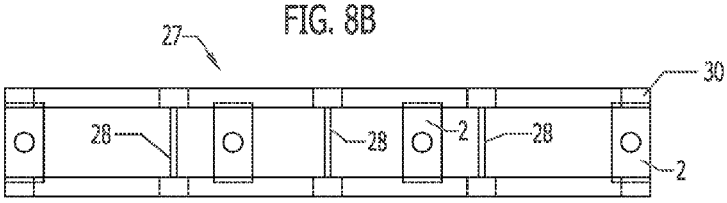

In operation, embodiments of building components of the present disclosure may be used as studs, plates, headers, or like components in wall assemblies in construction. Building components disclosed herein may take the place of traditional dimensional lumber or engineered wood studs, plates, and/or headers. Referring now to FIGS. 8A, 8B, and 8C, a wall assembly 27 is depicted using low thermal bridge studs 28 and plates 29, 30 as disclosed herein. FIGS. 8A and 8B depict side views of wall assembly 27 and FIG. 8C depicts a top view of wall assembly 27. The plates 29, 30 can be nailed or otherwise attached to the studs 28 to form the wall assembly 27. Two top plates 29 may be used in this wall assembly 27 to increase strength and support the roof. This configuration may reduce thermal bridging in comparison to traditional wall assemblies. The studs 28 and plates 29, 30 may be sized to accommodate the structural needs of the building or structure. They may also be sized to attain the desired wall thickness and/or to meet the insulation thickness requirements of the building and building codes. The wall assembly 27 may be suitable for insulation that is blown-in (e.g., urethane, cellulose, and fiberglass). It may be relatively easy to increase the wall thickness by increasing the width of webs 2, which may have little effect on cost or weight of the assembled wall 27. The studs 28, plates 29, 30, or other building components of a wall assembly may comprise various embodiments of building components having flanges and webs as disclosed herein.

Figure 9:
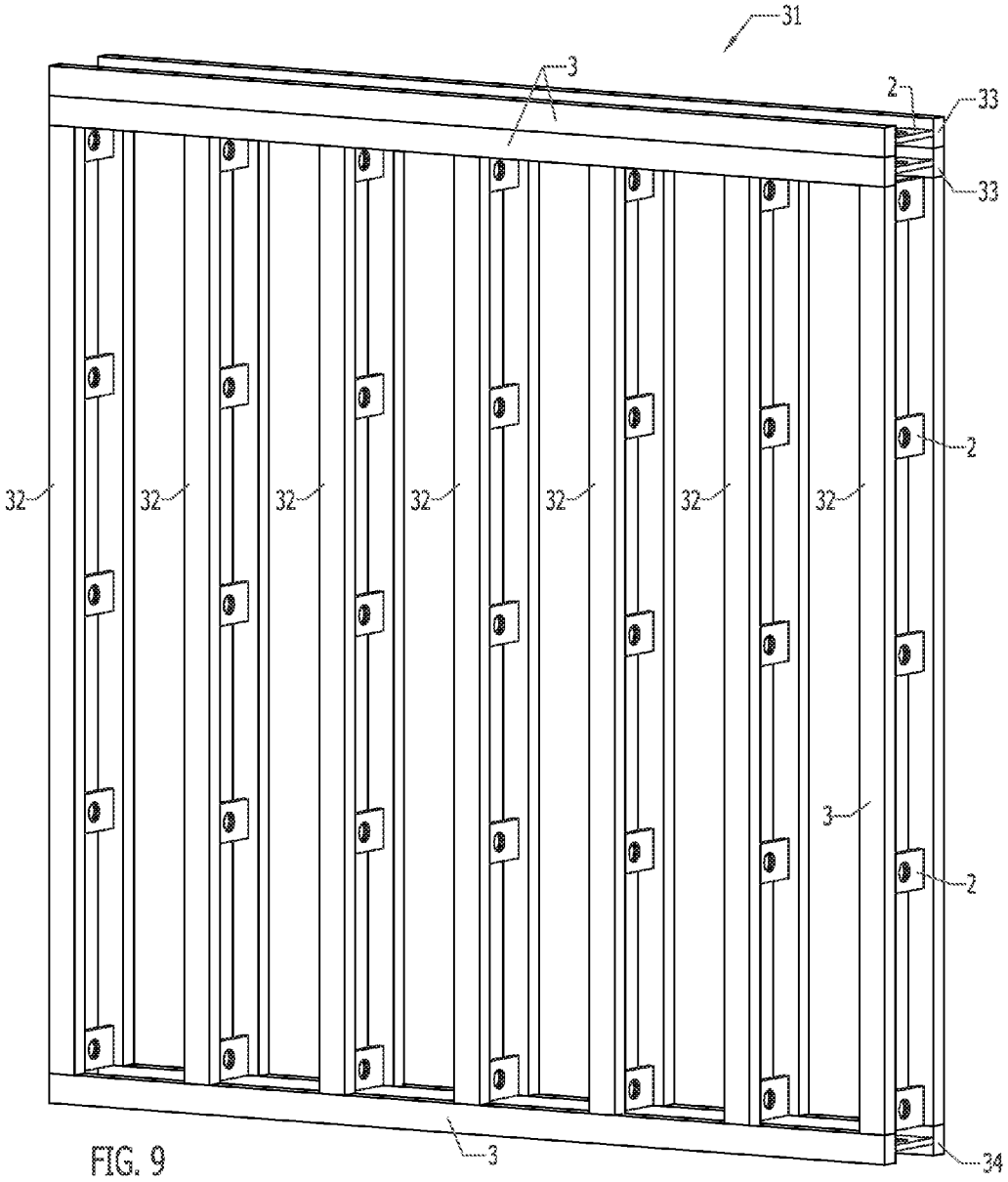
FIG. 9 is an axonometric representation of a reduced thermal bridge wall assembly according to embodiments of the present disclosure.

FIG. 9 is an axonometric drawing of a wall assembly 31 comprising building components studs 32 and plates 33, 34. Each stud and plate 33, 34 comprises two opposing flanges 3 and multiple web pieces 2. FIG. 9 illustrates that electrical and instrument wiring may be routed within the wall assembly 31 through spaces in each component 32, 33, 34. Where climates allow, plumbing may also be routed through the wall 31. Because the webs 2 provide communication between adjacent studs 32, wiring and plumbing could be passed through the walls 37 without drilling access holes through solid studs, as is currently done in typical construction. This feature may significantly reduce the amount of labor exerted during construction. The studs 32 and plates 33, 34 could also be used in interior walls to allow easy routing of wiring and plumbing. The wall assembly 31 may have significantly less mass than a traditional wall assembly.

Figure 10:
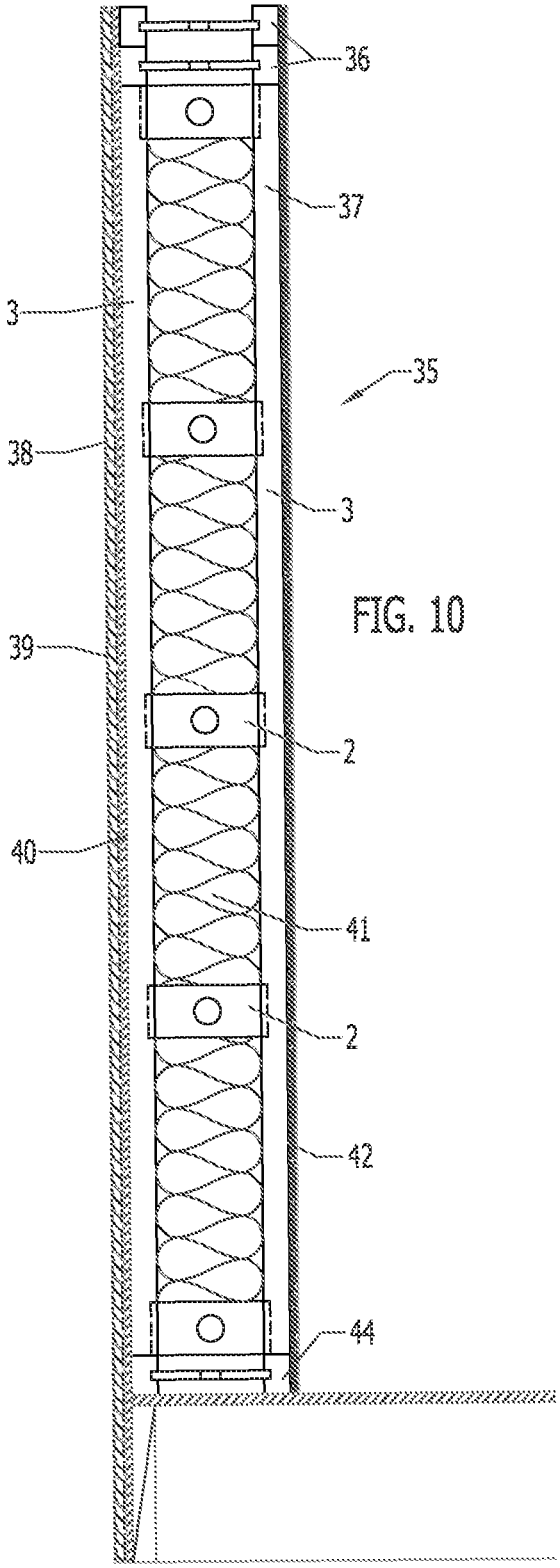
FIG. 10 is two-dimensional cross-sectional view depicting an embodiment of the present disclosure assembled within a wall section.

FIG. 10 is a two-dimensional cross-sectional view depicting various building components 36, 37, 44 of the present disclosure assembled within a wall section 35. Spaces between webs 2 can be used to route wiring and plumbing without the need to drill holes as is the case when traditional dimensional lumber is used to construct wall assemblies. Insulation 41 may fill in any voids between webs 2 and/or between studs 37 to mitigate air movement within the wall section 35. Wall surface panels 39, for example rigid board insulation, may be attached to outer-facing surfaces of building components 36, 37, 44 as is typically practiced in the art. Vertical battens 40 may be installed on wall surface 39. Siding 41 or other outer covering may then be installed on the exterior of wall assembly 35. Sheetrock 42 or similar interior panels may be installed in inner-facing surfaces of components 36, 37, 44.

As one of ordinary skill having the benefit of this disclosure would understand, embodiments presented herein may provide certain useful advantages over traditional building components and techniques. Such benefits may include reduced conductive heat transfer through building walls and thus reduced energy consumption. Another benefit may include a greater degree of design selection flexibility, including the ability to selectively vary wall thickness by selectively altering the size of the webs. Additionally, a thicker wall may permit an increased amount of insulation material to be placed therein. Walls constructed with embodiments of the present disclosure may be lighter in weight than similar sized walls constructed with traditional studs and other components. Lighter walls may be less costly to transport to a building site.

Walls constructed with embodiments of the present disclosure may also use less lumber than similar-sized walls that are constructed using dimensional lumber or other traditional building components. Low thermal-bridging building components of the present disclosure can simplify the construction of highly-insulated buildings and thereby result in reduced construction and material costs.

Although the present disclosure is described in terms of certain preferred embodiments, other embodiments will be apparent to those of ordinary skill in the art, given the benefit of this disclosure, including embodiments that do not provide all of the benefits and features set forth herein, which are also within the scope of this disclosure. It is to be understood that other embodiments may be utilized, without departing from the spirit and scope of the present disclosure.

What is claimed is:

1. A low thermal bridge building component comprising:
at least two flanges, each one of the at least two flanges comprising an outer surface, and
a web joining the at least two flanges and maintaining the outer surfaces of the at least two flanges in a roughly parallel configuration;
wherein:
the web has an R-value between 12 and 54 and
the web comprises a perforation.

2. The low thermal bridge building component of claim 1, wherein the at least two flanges are manufactured from lumber.

3. The low thermal bridge building component of claim 1, wherein the at least two flanges are manufactured from a material selected from the group consisting of aluminum, steel, plastic, insulation, and plastic composites.

4. The low thermal bridge building component of claim 1, wherein the web comprises a honeycomb or rigid foam material.

5. The low thermal bridge building component of claim 1, wherein the low thermal bridge building component has an approximate overall thickness of 3.5 inches, 5.5 inches, 7.25 inches, 9.25 inches, or 11.25 inches, wherein the overall thickness is defined as a measurement between outer opposing surfaces of the at least two flanges.

6. The low thermal bridge building component of claim 5, wherein:
the low thermal bridge building component has an approximate overall thickness of 5.5 inches and
the low thermal bridge building component has a weight of less than 14 pounds per 8 foot length.

7. The low thermal bridge building component of claim 5, wherein:
the low thermal bridge building component has an approximate overall thickness of 7.25 inches and
the low thermal bridge building component has a weight of less than 19 pounds per 8 foot length.

8. The low thermal bridge building component of claim 5, wherein:
the low thermal bridge building component has an approximate overall thickness of 9.25 inches and
the low thermal bridge building component has a weight of less than 24 pounds per 8 foot length.

9. The low thermal bridge building component of claim 5, wherein:
the low thermal bridge building component has an approximate overall thickness of 11.25 inches and
the low thermal bridge building component has a weight of less than 30 pounds per 8 foot length.

10. The low thermal bridge building component of claim 1, wherein the building component is selected from the group consisting of a wall plate and a wall stud.

11. The low thermal bridge building component of claim 1, wherein the low thermal bridge building component has an R-value between 16 and 58.

12. The low thermal bridge building component of claim 1, wherein each one of the at least two flanges comprises a C-shape.

13. A low thermal bridge building component comprising:
at least two opposing flanges and
a web joining the at least two flanges and maintaining the at least two flanges in a roughly parallel configuration;
wherein:
the web comprises a single, integral web member;
the web member is the only member that joins the at least two flanges; and
the web has an R-value between 12 and 54.

14. The low thermal bridge building component of claim 13, wherein the web comprises a honeycomb or rigid foam material.

15. The low thermal bridge building component of claim 13, wherein the low thermal bridge building component has an R-value between 16 and 58.

16. The low thermal bridge building component of claim 13, wherein each one of the at least two flanges comprises a C-shape.

* * * * *